United States Patent [19]

Larinoff

[11] Patent Number: 4,905,474

[45] Date of Patent: Mar. 6, 1990

[54] AIR-COOLED VACUUM STEAM CONDENSER

[76] Inventor: Michael W. Larinoff, 370 Holly Hill Rd., Oldsmar, Fla. 34677

[21] Appl. No.: 206,095

[22] Filed: Jun. 13, 1988

[51] Int. Cl.[4] ..... F28B 3/00

[52] U.S. Cl. ..... 60/692; 165/111; 165/114; 165/113

[58] Field of Search ..... 165/111, 113, 114, 146, 165/900; 60/690, 692

[56] References Cited

U.S. PATENT DOCUMENTS

| | | | |
|---|---|---|---|
| 3,543,843 | 12/1970 | Gunter | 165/146 X |
| 3,556,204 | 1/1971 | Dehne | 165/111 X |
| 3,677,338 | 7/1972 | Staub | 165/111 |
| 3,707,185 | 12/1972 | Modine et al. | 165/111 |
| 4,129,180 | 12/1978 | Larinoff | 165/113 |
| 4,518,035 | 5/1985 | Larinoff | 165/900 X |

*Primary Examiner*—Allen M. Ostrager

*Attorney, Agent, or Firm*—Dominik, Stein, Saccocio, Reese, Colitz & Van Der Wall

[57] ABSTRACT

An improved air-cooled vacuum steam condenser in a steam turbine cycle comprising a turbine for generating mechanical power, a boiler for generating steam, a conduit arrangement coupling the boiler to the turbine and then another conduit arrangement coupling the turbine exhaust back to the boiler through steam condensing mechanism. The steam condensing mechanisms include a plurality of finned tubes through which the expanded exhaust steam may flow counter to its condensate and be condensed; a plurality of front headers at the lower ends of the condensing tubes for conveying the exhaust steam from the turbine and receiving the condensate from the finned tubes; a plurality of rear headers at the upper ends of the condensing tubes for receiving the non-condensible gasses; and means in the rear headers to remove non-condensible gasses from the rear headers.

12 Claims, 5 Drawing Sheets

AIR-COOLED VACUUM STEAM CONDENSER

BACKGROUND OF THE INVENTION

This invention relates to improved air-cooled vacuum steam condensers serving steam turbine power cycles or the like and, more particularly, to improved apparatus for condensing steam or other vapors and draining the condensate over a wide range of loads, pressures and ambient air temperatures and also completely removing the steam-transported, undesirable, non-condensible gasses that migrate and collect at the end of the steam condensing system.

DESCRIPTION OF THE BACKGROUND ART

One technique for generating mechanical energy is the use of a turbine, boiler and an array of coupling conduits. Water is first converted to steam in the boiler. The steam is then conveyed to the turbine wherein the steam is expanded in its passage through rotating blades thereby generating shaft power. An array of conduits couple the turbine and the boiler and also define a working fluid return path from the turbine back to the boiler through steam condenser mechanisms in a continuing cycle of operation.

Steam condenser mechanisms include air-cooled vacuum steam condensers which may be considered as being comprised of four basic elements or systems: the steam condensing system, the air moving system, the condensate drain system and the non-condensible gas removal system.

The main problems plaguing the industry today are in the condensate drain and non-condensible gas removal systems that result in condensate freezing followed by the rupturing of bundle drains and heat exchanger tubes. The reasons for their failures can be traced to faulty condensate-drain hydraulic-design, the trapping of non-condensible gasses in the rear headers of the heat exchanger bundles and inadequate freeze protection. The problems are aggravated further by the wide range of plant operating conditions imposed upon the equipment and by low ambient air temperatures coupled with high winds.

Various approaches are disclosed in the patent literature to improve the efficiency, hydraulics, freeze protection and control of air-cooled vacuum steam condensers and related devices. By way of example, note U.S. Pat. Nos. 2,217,410 to Howard and 3,289,742 to Niemann. These patents disclose early versions of heat exchangers for use in turbine systems. Other patents relating to improving air-cooled system steam condensers include U.S. Pat. Nos. 2,247,056 to Howard and 3,429,371 to Palmer. These patents are directed to control apparatus for accommodating pressure variations. In addition, U.S. Pat. No. 4,585,054 to Koprunner is directed to a condensate draining system. The linear arrangement of tubes in A-frame steam condensers is disclosed in U.S. Pat. Nos. 4177,859 to Gatti and 4,168,742 to Kluppel while U-shaped tubes are disclosed in U.S. Pat. Nos. 3,705,621 and 3,887,002 to Schoonman. In addition, applicant Larinoff describes a wide variety of improvements in air-cooled heat exchangers in his prior U.S. Pat. Nos. 3,968,836; 4,129,180; 4,240,502 and 4,518,035. Such improvements relate to condensate removal, air removal, tube construction, cooling controls and the like. Lastly, various improvements in mechanisms for non- analogous technologies are disclosed in U.S. Pat. Nos. 2,924,438 to Malkoff; 3,922,880 to Morris and 4,220,121 to Maggiorana.

As illustrated by the great number of prior patents and commercial devices, efforts are continuously being made in an attempt to improve air-cooled vacuum steam condensers having particular utility in systems configuration with steam turbine cycles. Such efforts are being made to render condensers more efficient, reliable, inexpensive and convenient to use, particularly over a wider range of thermal operating conditions. None of these previous efforts, however, provides the benefits attendant with the present invention. Additionally, the prior patents and commercial devices do not suggest the present inventive combination of component elements arranged and configured as disclosed and claimed herein. The present invention achieves its intended purposes, objects and advantages over known devices through a new, useful and unobvious combination of component elements, with the use of a minimum number of functioning parts, at a reasonable or lower cost to manufacture, and by employing only readily available materials.

Therefore, it is an object of this invention to provide an improved turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms, the condensing mechanisms include a plurality of finned tubes through which the expanded exhaust steam flows and is condensed; a plurality of bundle front headers at the lower ends of the condensing tubes for receiving exhaust steam from the turbine; a plurality of bundle rear headers at the output ends of the condensing tubes for receiving condensate and non-condensible gasses; and means in the rear headers to remove non-condensible gasses from the rear headers.

It is yet another object of this invention to properly and completely drain condensate from air-cooled steam condenser systems and protect them from freezing.

Lastly it is a further object of the present invention to completely remove undesired gasses from the terminal points of a steam condensing system which are the cause of freezing problems and tube corrosion.

The foregoing has outlined some of the more pertinent objects of the invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiment in addition to the scope of the invention defined by the claims taken in conjunction with the accompanying drawings.

SUMMARY OF THE INVENTION

The invention is defined by the appended claims with the specific embodiment shown in the attached drawings. For the purpose of summarizing the invention, the invention may be incorporated into an improved steam powered system comprising a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms, the condensing mechanisms including a plurality of finned tubes through which the expanded exhaust steam flows and is condensed; a plurality of bundle front headers at the lower ends of the condensing tubes for receiving exhaust steam from the turbine; a plurality of bundle rear headers at the higher ends of the condensing tubes for receiving non-condensible gasses; and means in the rear headers to remove non-condensible gases from the rear headers. The last mentioned means includes a suction sparger extending the length of each rear header with a plurality of orifices spaced along the length of the sparger. The draining condensate inside the tubes flows downwardly against the upward flow of the steam in a scrubbing manner for reheating purposes. The system further includes condensate reheating means in the front headers positioned in the path of the falling condensate to bring the condensate back to saturation temperature.

The invention may also be incorporated into a condensing and draining mechanism for use in a steam condenser comprising a plurality of condensing tubes through which steam may flow for being condensed into water and continually drained therefrom; a plurality of front headers at the lower ends of the condensing tubes for receiving steam to be condensed; a plurality of rear headers at the upper ends of the condensing tubes for receiving non-condensible gasses from the condensing tubes; and heat transfer fins on the condensing tubes to facilitate steam condensing within the tubes, such fins extending downwardly from the rear headers toward the front headers and in the area below the pre-condensers the fins are of varying predetermined lengths to control air temperature enveloping the pre-condenser tubes.

The invention may also be incorporated into a mechanism to remove non-condensible gasses in a steam condenser comprising a plurality of condensing tubes through which exhaust steam may flow for being condensed into water and non-condensible gasses to be removed; a plurality of lower headers at the input end of the condensing tubes for receiving exhaust steam to be condensed; a plurality of rear headers at the output ends of the condensing tubes for receiving non-condensible gasses from the condensing tubes; suction sparger with orifices installed within each of the rear headers to receive non-condensible gas mixtures; and connecting piping extending downwardly from each suction sparger toward the front headers to couple to each pre-condenser tube for the removal of the non-condensible gasses. The plurality of condensing tubes are arranged in bundles with a plurality of rows of condensing tubes in each bundle and with each row of each bundle terminating in a separate rear header and with a separate suction sparger installed in each rear header. The mechanism further includes an air-cooled pre-condenser tube set in a select and predetermined air temperature zone of the main condenser coupling a preselected suction sparger from each tube row of each bundle. The mechanism further includes a fist-stage steam jet air ejector for each precondenser tube row. The mechanism further includes a second-stage ejector, an intercondenser and an after-condenser coupled to the output of the first-stage steam jet air ejectors. The orifices in the suction sparger are of varying diameters in each row for equalizing the mass flow of non-condensible gas mixtures (i) along the length of the rear headers (ii) from tube row to tube row, and from the (iii) various bundles as located throughout the tower structure.

The invention may also be incorporated into a device for condensing steam and for removing the non-condensible gasses therefrom, an improved conduit arrangement defining a gas/vapor path extending from a lower header to an upper header with condensing tubes extending therebetween for steam as it moves from the front header toward the rear header, a sparger located in operative association with the rear header for receiving the non-condensible gasses freed from the steam during its condensation and for the removing of such non-condensible gasses from the system.

Lastly, the invention may also be incorporated into apparatus for removing non-condensible gasses from steam being condensed as it moves upwardly through tubes from a front header toward a rear header, means located in the rear and last header for the receipt of the non-condensible gasses generated from the steam being condensed, the means having a plurality of orifices along its length and adapted to be coupled to a first stage ejector.

The foregoing has outlined rather broadly the more pertinent and important features of the present invention in order that the detailed description of the invention that follows may be better understood so that the present contribution to the art can be more fully appreciated. Additional features of the invention will be described hereinafter which form the subject of the claims of the invention. It should be appreciated by those skilled in the art that the conception and the disclosed specific embodiment may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be had to the following detailed description taken in conjunction with the accompanying drawings in which.

Similar referenced characters refer to similar parts throughout the several Figures.

DETAILED DESCRIPTION OF THE INVENTION

Overview

Figure 1:
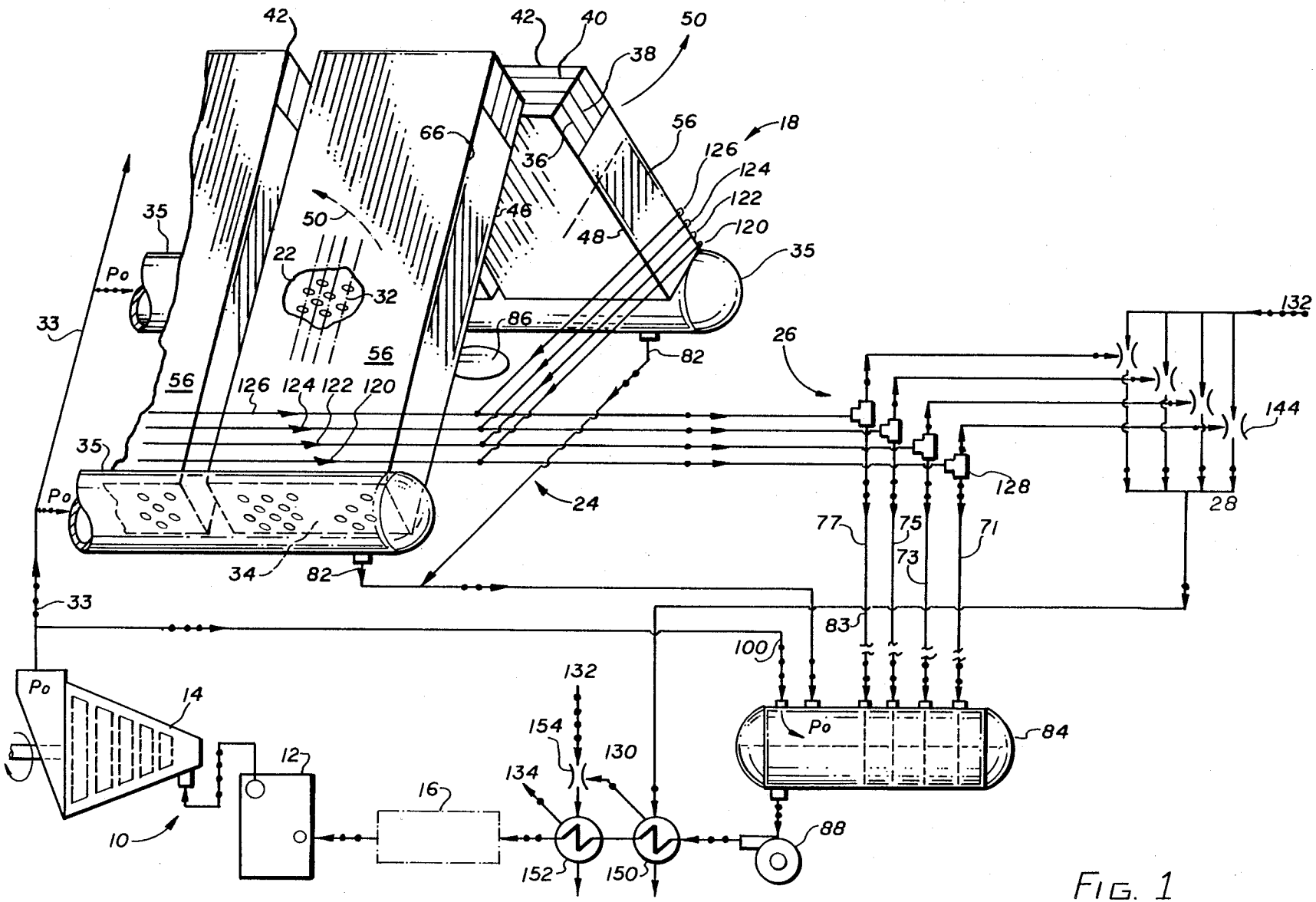
FIG. 1 is a simplified version of a steam power cycle that is a partially schematic and a partially diagrammatic illustration of a boiler, turbine, pumps, coupling conduits and an air-cooled steam condenser. The condenser shown is an "A" frame design with steam flowing upward in the finned tubes while condensate drains downward to the steam supply duct in a counter-flow manner. It is mechanical forced draft with condensate drain to a storage tank and a two stage steam operated air removal system.

With reference to FIG. 1, there is shown a power system 10 for converting thermal energy into mechanical energy. The system includes a boiler 12 for generating steam and a turbine 14 which expands the high pressure steam thereby converting its energy into shaft power. The waste steam exhausted from the turbine is condensed in an air-cooled steam condenser 18 and the condensate is returned to the power cycle via conduits 16 and auxiliaries. The steam condensing mechanism 18 consists of sub-systems which may be considered as including a steam condensing system 22, an air moving system 24, a condensate drain system 26 and a gas removal vacuum system 28.

Steam Condensing System

Figure 5:
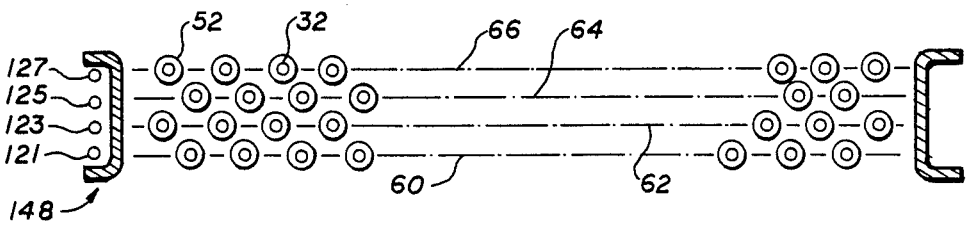
FIG. 5 is a sectional view through the bundle showing finned tubes attached four rows deep. It also shows the evacuation piping placed inside the bundle channel frame.
Figure 6:
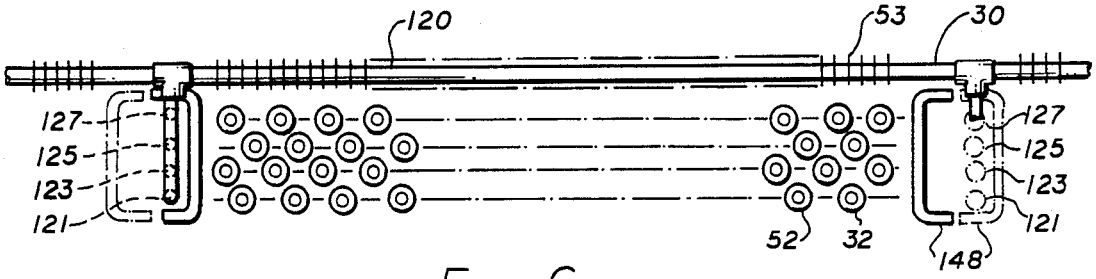
FIG. 6 is a sectional view across a bundle showing the air-cooled pre-condenser set on top of the frame with piping leading to the rear headers.
Figure 9:
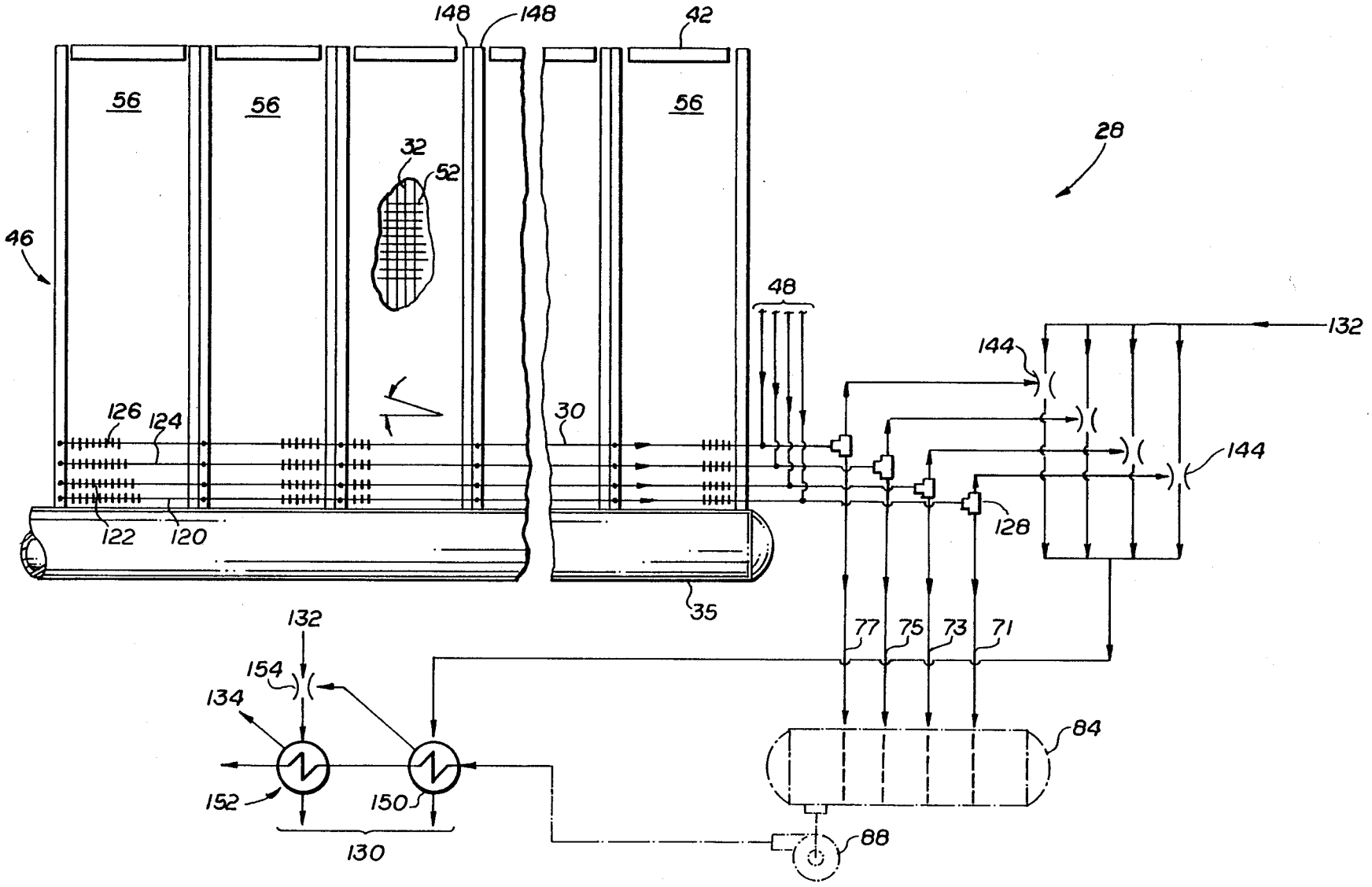
FIG. 9 is a flow diagram of the gas removal vacuum system. It shows the pre-condenser resting on top of the bundles close to the steam supply duct.

The steam condensing mechanism employed in the preferred embodiment of the present invention consists of a main steam duct 33 feeding a steam supply duct 35 to which the steam condensing bundles 56 are attached at the front header 34. The exhaust steam flows upward through a plurality of parallel finned tubes 32 where it is condensed and the condensate runs downward in the same tubes in counter-flow manner back into the steam supply duct 35. In the disclosed preferred embodiment, the bundles 56 are arranged in two banks 46 and 48 in an A-frame configuration with the front header 34 on the bottom and the rear headers 36, 38, 40 and 42 on the top with a bundle air seal 164 at the apex. The tubes 32 are provided with fins 52 to facilitate and promote more efficient heat transfer. The heat transfer involves the flow of ambient air 50 over the finned tubes for cooling purposes to condense the steam into water. The condenser tubes of each bank are separated into a plurality of bundles 56 as shown in FIGS. 1 and 9. Within each bundle, the tubes are arranged in a plurality of rows 60, 62, 64 and 66, four in the disclosed preferred embodiment as shown in FIG. 5. The four parallel rows are symmetrically positioned in the bundle with the cold ambient air striking row 60 first while the heated air leaving row 66 is discharged back into the atmosphere.

Each row of tubes has its own rear header 36, 38, 40 and 42 which are the terminal points of the steam condensing system and therefore the gathering points for all the non-condensible gasses released by the condensing steam. While the steam moves upward through the tubes, the condensate flows downward by gravity in the same tubes and drains into the steam supply duct 35.

The steam condensing system employed in this invention may be considered as consisting of a single-pass, multi-row, extended surface, air-cooled, heat exchanger bundles with a separate rear header for each row. The tubes are in a single pass arrangement in relation to the air flow on the outside and the steam flows counter to its condensate inside the tubes. The bundle arrangement must be inclined toward the front header 34 sufficiently so that the condensate can drain by gravity back into the steam supply duct 35. From that minimum position it can be tilted upward until it is completely vertical to meet design/installation requirements.

The important advantages of this new steam condensing system can be set forth as follows. A. This design does not require additional devices for the withdrawal of condensate from the bundles. B. The counter-flow movement of steam and condensate inside the same tubes produces a condensate temperature close to the saturation temperature of the steam. C. Final condensate saturation temperature can be achieved by the use of a separate reheating element installed in the steam supply duct. D. Most importantly, this design has a low internal steam pressure drop because of its short steam-condensing path length. This means the condenser can operate with a lower turbine exhaust pressure during cold weather which is very desirable from a plant thermal efficiency aspect.

Air Moving System

The air moving system 24 employed in the disclosed preferred embodiments of this invention is the conventional industry type shown in the patent literature. It preferably employs either mechanical draft fans 86, natural draft or some combination of both. The fan arrangements can be either of the induced or forced draft type. In all cases the forced air flow 50 across the outside of the finned tubes is the cooling medium that condenses the steam inside the tubes.

It should be noted here that, although the bundles employed in this invention show four rows, all the disclosures in this patent apply to bundles of one or more rows.

Condensate Drain System

Figure 2:
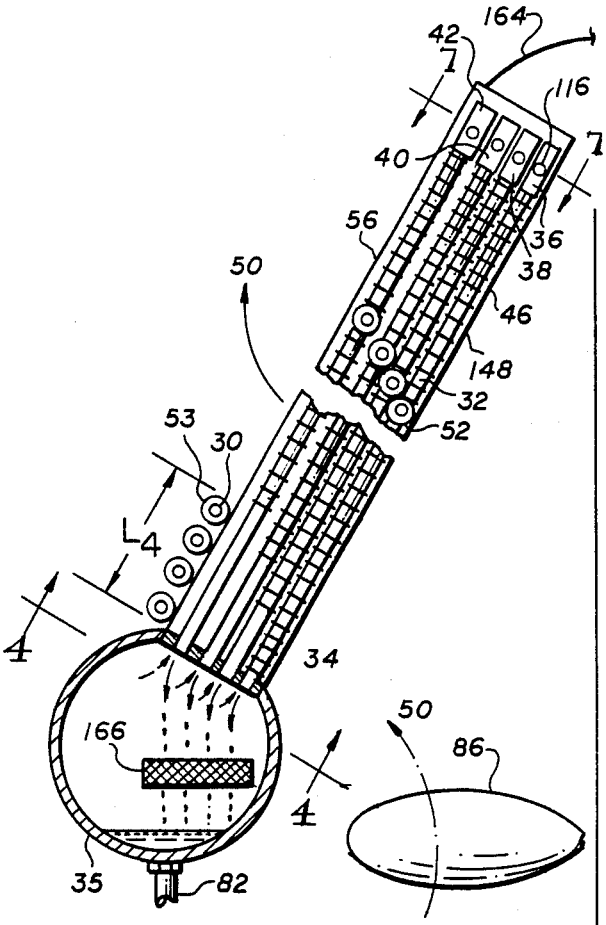
FIGS. 2 and 3 are elevational drawings with vertical sections through the bundles and with a forced draft fan in the middle serving both banks.
Figure 3:
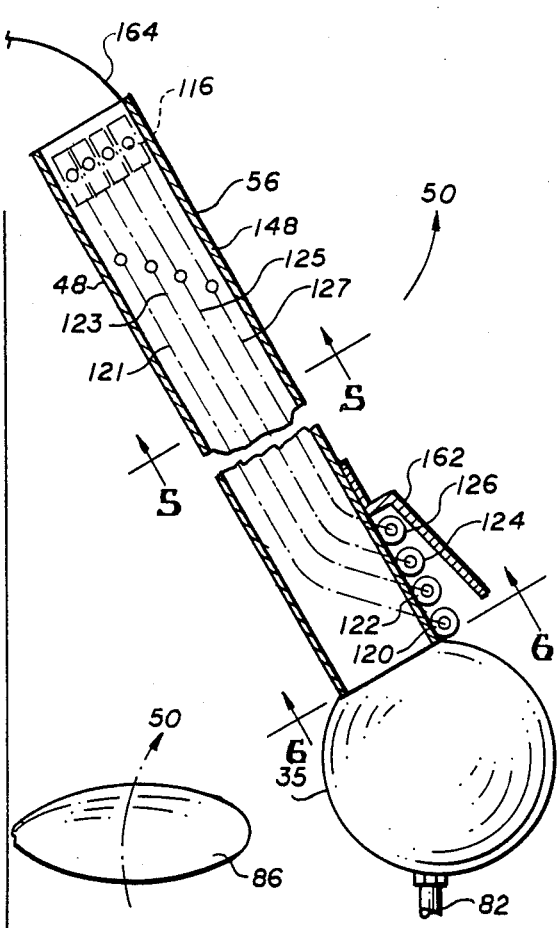
Figure 4:
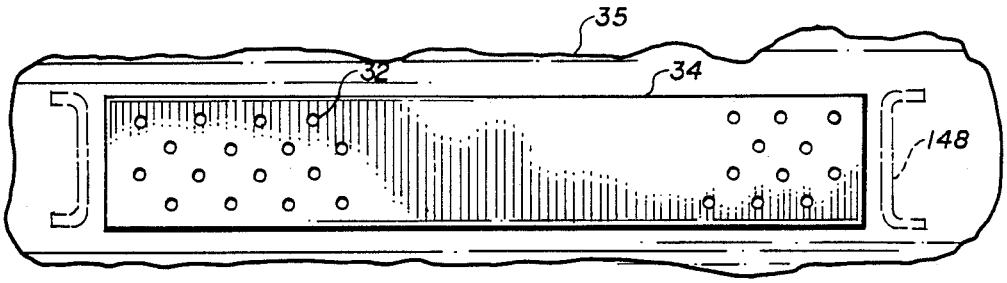
FIG. 4 is a view of the front header showing its tube holes where the exhaust steam enters to be condensed.

The condensate drain system starts at the point where the condensate flows out of the finned condensing tubes 32 into the steam supply duct 35 by gravity as shown in FIG. 2. Its vertical fall is intercepted by a condensate reheating element 166. During cold weather the condensate is subcooled by its contact with the metal walls of tube 32 but it can be readily reheated to the steam saturation temperature by breaking it up into droplets and thin films and delaying its fall. The condensate reheating element 166 can do this with an interwoven mesh material or some other such device that is at saturation temperature being suspended in this steam atmosphere. The reheating element can also be constructed of tray and baffles similar to designs presently employed in commercial heaters. This element provides the added contact surface area and time delay that is necessary to bring the condensate back up to the desired saturation temperature.

Returning to FIG. 1, condensate flow from steam supply duct 35 is via pipe manifold 82 into drain pipe 83 and then into tank 84. The steam pressure inside tank 84 is the same as that in supply duct 35 because of piping connection 100. The condensate flow from supply duct 35 to storage tank 84 is entirely by gravity. Condensate pumps 88 take suction from the storage tank and return the condensate back to the power cycle to repeat the process.

Gas Removal Vacuum System

One of the most important aspects of the present invention is the gas removal vacuum system. It is the subject of another U.S. Patent Application Ser. No. 07/206,094, filed on the same date herewith by the same inventor. The difference between these two systems is the manner in which the condensate is drained from the pre-condensers. In the companion invention, the steam which is condensed in the pre-condensers flows back into the bundle rear headers by gravity where it mixes with the bulk of the condensate and is withdrawn from the system by means of water legs. In this present invention the steam which is condensed in connecting piping (121, 123, 125 and 127) and in the pre-condensers flows by gravity directly into the condensate storage tank 84 via a fluid separating connection 128.

For a better understanding of what is being proposed in this invention as regards the removal of non-condensible gasses from air-cooled steam condensers, a short review of past arrangements and problems is helpful.

First, to answer the question as to what are these non-condensible mixed gasses in the exhaust steam of power cycles. These inert gasses are the result of boiler water treating chemicals that are continually injected into the boiler feed water system. They vaporize in the boiler drum but do not all condense when cooled down. They also are the result of air leakage around shaft seals such as the turbine, condensate pumps and valve stems. Air leakage also occurs at the welded joints of the steam condensing system which includes steam ducts, manholes, bundles, tanks, condensate piping, etc. There could be a large presence of inert gasses in the turbine exhaust steam.

The second question that arises is why are they important in the design consideration of steam condensers. These inert gasses can cause tube corrosion, but more importantly, tube failures resulting from freezing. These gasses are frequently trapped in stagnant pockets in rear headers which then grow in size and progress down into the condensing tubes. If there is condensate present, it can freeze because the stagnant gas pockets become cold, having displaced the steam. Frozen condensate can rupture tubes and pipes that will shut down the power generating unit. During the summer these same gas pockets will blanket finned-tube heat-transfer surfaces thereby degrading the plant's thermal performance.

Knowing what these inert gasses are and what they do, we can now examine how they have been handled in the past and compare that with what is now being proposed. FIGS. 10A, 10B, 10C and 10D present the various design attempts in removing the undesirable gasses from the condenser. The IDEAL gas removal design shown in FIG. 10A would be a cone-shaped bundle where steam (S) enters the cavity and is condensed leaving the gasses behind. As more steam enters and condenses, the gasses are pushed further and further ahead until finally they reach the tip of the cone where there is practically no steam and all gas. The first-stage ejector then "sucks" out nearly pure gas and discharges it from the system. There are no stagnant pockets in the IDEAL design because of its cone shape, however, this bundle cannot be built and remains only as an ideal concept.

Figure 10D:
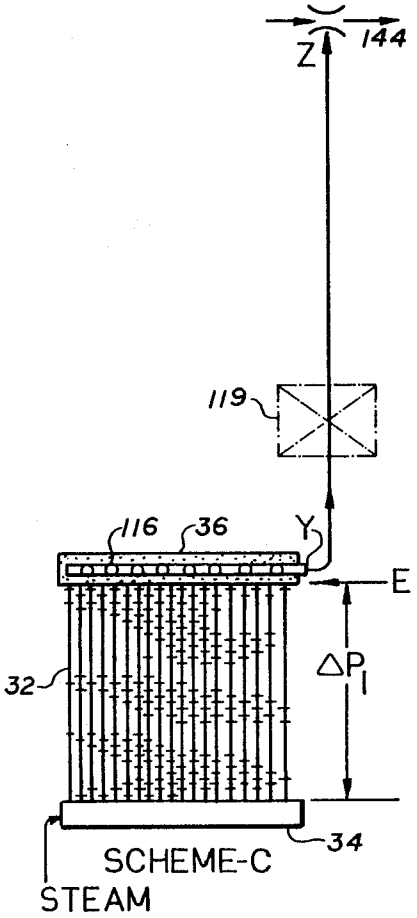
FIG. 10A, 10B, 10C and 10C are simplified versions of bundle gas removal designs that have been used in the past and compared to the proposed system.
Figure 10C:
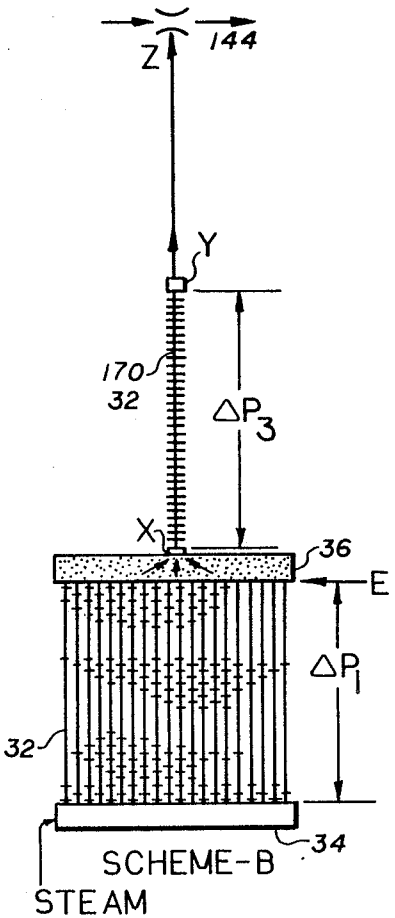
Figure 10B:
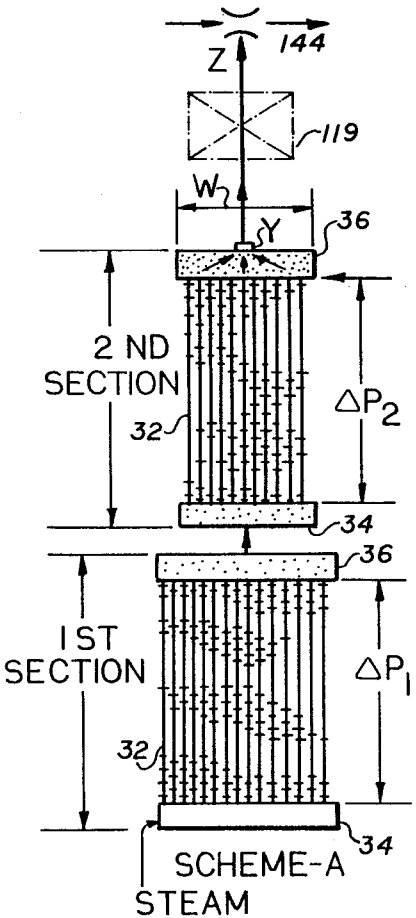
Figure 10A:
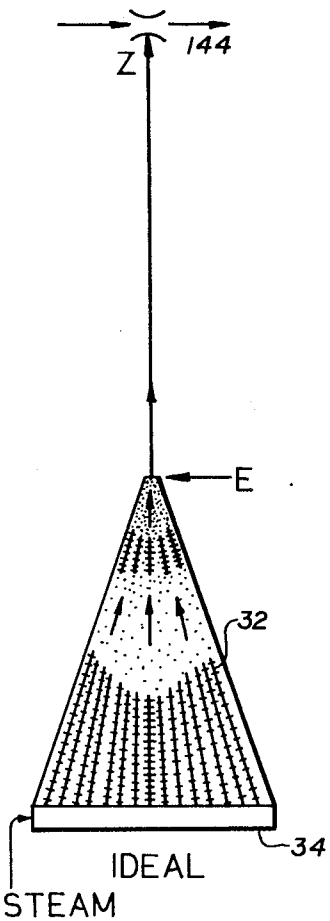

Scheme A, FIG. 10B, shows past attempts by industry at solving this problem. The total steam condensing surface is built in two sections or zones. They could be separate bundles as shown or they could be incorporated in the same bundle. The attempt here is to try to concentrate the inert gasses before they are withdrawn at point Y. The two sections could have the same heat transfer capacity or the second section could be as small as five per cent of the heat transfer surface area of the first section. The rear header 36 of the first section may or may not be the cavity which serves as the front header 34 for the second section. There are many design variations on this connection. The patent literature shows the following names for the first section: Main Condenser, Primary Condenser, First Condensing Zone and First Plurality Tubes. The second section names have been shown as: Dephlegmator, Vent Condenser, Secondary Condenser, After Condenser, Aftercooler Section, Second Condensing Zone, Second Plurality of Tubes and Reflux Condenser.

Regardless of the name, bundle size, shape, tube passes, tube arrangement, configuration, etc., the design aim is always to drive the gasses toward the terminal end (E) of the condenser and then remove them with an ejector system. A typical rear header length, which is the bundle width (W), could be as large as ten feet. There could be fifty finned tubes in this width all discharging gasses into the rear header. However, the gas quantities entrapped in the steam are minute by comparison to the total mass of steam being condensed. Typically in a small condensing system for every 1,000 lbs/hr of steam entering a bundle with a fifty tube row there is less than 1.0 lbs/hr of gas vapor mixture that is sucked out of the rear header at point Y by the first stage ejector. Considering the internal volume of a rear header that is ten feet long, a 1.0 lb/hr flow withdrawal rate toward the one pipe connection (Y) is very, very small.

With this arrangement where there is but one pipe connection from the rear header to the ejector, it is quite obvious that there will be stagnant pockets of inert gasses in the rear header as shown in FIG. 10B. In fact, the real danger is that these pockets will extend down into the finned tubes along both sides of the bundle where freeze damage then occurs. The vapor/gas fluid being withdrawn by the ejector is that which comes mainly from the finned tubes in the immediate vicinity of the suction opening (Y). These few tubes opposite opening (Y) bring in a continual supply of additional steam and gas into the withdrawal area where all the action takes place. The remaining tubes, which are the majority, merely stagnate with gas movement created mainly by molecular diffusion and small eddies rather than pressure gradients. The inert gasses keep accumulating and concentrating inside the tubes along the sides of the bundle with very slow movement toward the suction opening (Y). That is the nature of fluid movements with the type of containment and withdrawal arrangements presently practiced.

Scheme B, FIG. 10C, has a main condenser where each bundle rear header 36 has a vent tube or tubes. This vent tube 170 is finned similar to the main condenser. It is in essence a pre-condenser to the first stage ejector which is built into the same bundle as the main condenser. This scheme does a better scavenging job of the rear header than does Scheme A. The mass volume of gas/vapor mixture leaving the bundle at (Y) and entering the ejector at (Z) is the same for both Scheme A and B. The mass volume of gas/vapor leaving the rear header of Scheme B at point (X) is considerably larger than that leaving at point (Y), Scheme A, due to the condensation of steam vapor in the vent tube. Since the mass volume flow at point (X), Scheme B, is larger, the flow volumes and velocities around suction opening (X) are higher. However, this design has the same basic flaw that Scheme A has in that the flow into suction opening (X) comes mostly from tubes in the immediate vicinity of the opening. The rest of the rear header and the tubes along the sides to the bundle stagnate.

Scheme C, shown in FIG. 10D, is the new invention with its suction sparger that shows how it proposes to scavenge the rear header by the vary nature of its construction.

The purpose of this system is to remove all of the non-condensible gasses from the bundle rear headers 36, 38, 40 and 42. These non-condensible gasses are part of the normal steam cycle vapor system and become the gas residue when the vapors are condensed. A flow diagram of the gas removal vacuum system 28 of the present invention is shown in FIGS. 1 and 9. The gas removal starts with the suction sparger 116 installed in all rear headers; then piping 121, 123, 125 and 127 connecting the suction spargers to pre-condensers 120, 122, 124 and 126; then additional piping connects the pre-condensers to a liquid/vapor separator 128 where the liquid flows to the condensate storage tank 84 by gravity while the gasses and vapors flow to the first-stage ejectors; then the gasses and vapors enter the steam jet air ejector package 130 where the gasses are further concentrated and then ejected from the system into the atmosphere at point 134 while the condensate from the steam vapors is returned to the cycle. A more detailed explanation of each of these gas removal steps follows.

Figure 7:
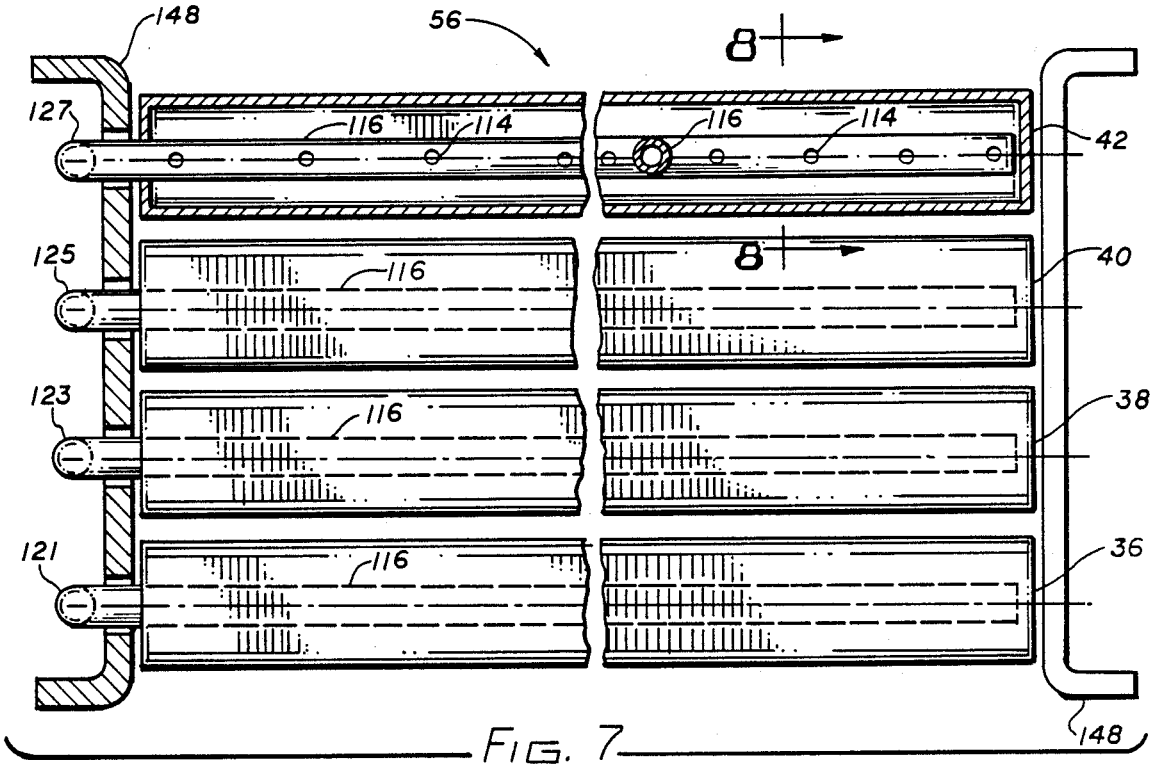
FIG. 7 is a view looking into the rear header end of the bundle. It shows the vent manifolds inside each of the four rear manifolds.
Figure 8:
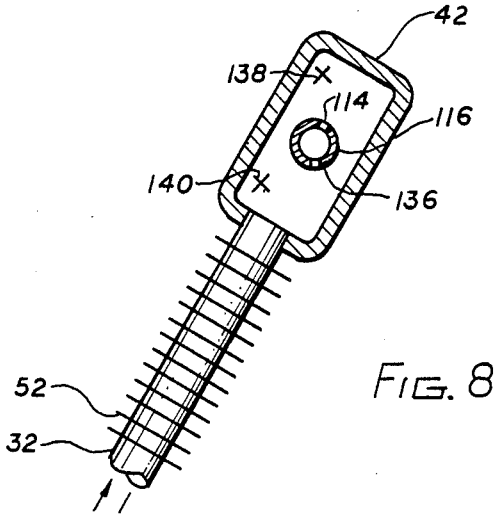
FIG. 8 is a sectional view of a rear header showing the placement of the vent manifold and its orifices.

As was stated earlier, the inert gasses all end up in the rear headers 36, 38, 40 and 42. To remove them from the rear headers, it is necessary to create a higher vacuum which is a lower absolute pressure than that which exists in the rear headers. This is accomplished by the first-stage ejectors 144 and completed by the remainder of the steam jet air ejector package 130. The suction sparger 116 is the starting point for the gas removal process. Each rear header, of which there are four per bundle, has its own suction sparger running the full length of the rear header as shown in FIG. 7. The spargers have orifices 114 drilled along the entire length through which the gasses and vapors enter. Any condensate which enters the sparger either flows out of a single small drain hole 136 shown in FIG. 8 and located at the closed end, or it flows into connecting piping 121, 123, 125 and 127 and then drains into the pre-condenser. The vapor/gas flow from the rear header through the orifices is induced by the action of the steam jet ejectors. The orifices are positioned such that they face a calm area 138 as shown in FIG. 8 and are located midway between two adjacent tubes 32. The other side of the sparger pipe faces the heat exchanger tube 32 openings which is the turbulent zone or area 140. It is turbulent because there is some steam flow in the rear header between tubes in the same row. This steam interchange amongst tubes 32 occurs as a result of uneven cooling air velocities across the face of the bundle. Locating the suction orifices in the calm zone of the rear headers insures a more effective scavenging job. Since each condensing tube 32 discharges some gas, the multiplicity of suction orifices 114 means that the gasses have only to travel a few inches in the rear header before they enter an orifice in the suction sparger 116. This is unlike the usual steam condenser bundle rear header which has but one suction pipe connection where the gasses must travel from a minimum of a few inches to a maximum of five to ten feet, depending on the suction pipe location.

The orifices 114 vary in diameter (a) along the length of the suction sparger 116, (b) among each of the rear headers 36, 38 40 and 42 and (c) from bundle 56 to adjacent bundle 56. These orifices are sized to perform several important flow-equalizing functions. The national steam condenser code specifies the required evacuation capacity (lbs/hr) of the steam jet air ejector package 130 based on the size of steam condenser, i.e., mass quantity of steam condensed (lbs/hr). Hence, the orifices are sized to flow the code mandated capacity plus the steam vapor capacity condensed in a pre-condenser, if used. In this first calculation step an orifice diameter is found for each row knowing total flow quantities, total bundles and total orifices. Now since the bundles close to the first-stage ejectors will have less piping pressure drops, they would normally flow a larger amount of gas/vapors than the bundles located at the end of the tower. Hence, the first adjustment to the orifice diameters is to equalize the flows irrespective of the bundle location in the tower structure. That means that bundles located close to the first-stage ejectors will have smaller orifices than the bundles located at the end of the tower. With this adjustment all bundles will now deliver the same mass quantity of gas/vapor to the evacuation system. There is a second adjustment to be made to the orifice diameters which concerns operations inside the rear headers. Flow through the sparger orifices must be equalized along its entire length. This will insure that each increment of length along the rear headers is being evacuated evenly since each finned tube 32 is discharging very nearly the same quantity of gas. The orifice 114 openings near the front end of the sparger 116 will be slightly smaller than the orifices near the closed end which are further away and therefore have a larger piping pressure drop. A third adjustment concerns the individual rows. They each condense different quantities of steam and, therefore, have different quantities of vapor/gas to be evacuated through different size orifices.

The rear header evacuation piping 121, 123, 125 and 127 is run inside the bundle channel frame 148 as shown in FIGS. 3, 5, 6 and 7 and then brought outside with piping 30 running on top of the bundle frames near the steam supply duct 35 as shown in FIGS. 1, 2, 3, 6 and 9. By installing fins 53 on pipes 30, low-cost air-cooled pre-condensers 120, 122, 124 and 126 can be made to serve the first-stage ejectors 144. Such a pre-condenser increases the scavenging rate of the rear headers by the amount of steam vapor it condenses. In the process of doing that, it provides a more concentrated inert gas mixture to the ejectors which makes them more efficient.

The steam vapor condensing capability of this air-cooled pre-condenser is dependent upon, amongst other things, the temperature of the cooling air 50 passing through its fins 53 as it lies on top of the main steam condensing tubes 32. This air temperature in turn is controlled by the number of fins 52 installed on tubes 32 located directly below the pre-condensers. As the fins are stripped back along the tubes as shown in FIG. 2 the temperature of the air reaching the pre-condensers drops and then more steam vapor is condensed. FIG. 2 shows the top row fins stripped to a distance L while the bottom row is left intact; rows 2 and 3 are stripped varying amounts. This control of the number of heat dissipating fins built into the path of this small segment of cooling air gives the designer flexibility to maximize the steam vapor condensing capability of the pre-condenser and minimize the potential for freezing.

The air-cooled pre-condenser is installed in the warm air stream of the bundle air discharge to protect it from freezing. The vapor/gas mixture flowing in the pre-condenser tubes 30 does not carry much steam so that it does not have the self protection features as does the regular steam condensing tube 32. Although the pre-condenser is protected by being surrounded with heated air, it is still subject to freezing if it is not protected from cold blasting winds. In cold climate installations a removable, sheet-metal, protective wind shield 162, would be installed to partially cover the pre-condenser.

The pre-condenser is shown installed on the bottom of the bundles 56 near the steam supply duct 35 to achieve greatest freeze protection. In warmer climate installations the pre-condenser could be installed near the to of the bundles just below rear header 42. This would save piping costs for items 121, 123, 125 and 127.

Steam vapors condensed in connecting piping 121, 123, 125 and 127 and in pre-condensers 120, 122, 124 and 126 all drain by gravity toward the fluid separating connection 128. This is a "T" pipe connection installed in a vertical position as shown in FIGS. 1 and 9. The condensate flows downward through pipes 71, 73, 75 and 77 by gravity into the condensate storage tank 84, while the vapors and gasses flow upward through the tees toward the first-stage ejector 144. The condensate pipes 71, 73, 75 and 77 terminate below the water level in the tank because they also serve as water-leg seals. Condensate levels in these water legs are above the water level in the tank and each is at a different height because they all have different internal vapor pressures. In cold climate installations, the small condensate pipes 71, 73, 75 and 77 are fastened to the much larger and warmer pipe 83 and then all five pipes are wrapped with heat insulation as a single line.

The vapors and gasses leaving the fluid separator 128 enter the first-stage ejectors 144 of which there are four; one for each bundle row because they all have different pressures and cannot be tied together. The use of multiple first-stage ejectors discharging into a common inter-condenser is generally known in the existing art in the process, petrochemical, pharmaceutical and related industries. The process cycles generally have several points, at different pressures, which must be evacuated with their own first-stage ejectors which then discharge into the shell of a common condenser. As shown in FIGS. 1 and 9, the first-stage ejectors then discharge their mixture into inter-condenser 150 and the second-stage ejector 154 withdraws that shell mixture and discharges it to the after-condenser 152. The after-condenser condenses the remaining steam vapor and discharges the residue of inert gasses into the atmosphere via vent 134. This air ejection package 130 is a conventional steam operated 132 two-stage steam ejector unit with inter and after-condensers. Motor driven vacuum pumps with or without air ejectors could be readily substituted for the steam operated device shown.

The low-cost pre-condenser 120, 122, 124 and 126 would be installed when operating conditions indicated the need for additional scavenging of the rear headers. If they were not needed, then there would be some cost savings by eliminating the fins 53 on piping 30, the fluid separating connection 128 and the four condensate drain lines 71, 73, 75 and 77 and running the extraction piping 30 in the cavity below bundle air seal 164 FIGS. 2 and 3.

The invention may thus be considered as apparatus for condensing steam and for removing the non-condensible gasses therefrom. The apparatus includes an improved conduit arrangement defining a gas/vapor path extending from a lower first header to an upper second or last header with condensing tubes extending therebetween for steam as it moves upwardly through the condensing tubes from the front header toward the rear header. A sparger is located in operative association with the rear and header and is formed with a plurality of orifices along its length for receiving the non-condensible gasses freed from the steam during its condensation and for the removing of such non-condensible gasses from the system. The sparger is then coupled to a first stage ejector.

Although the preferred arrangement as illustrated in the drawings of this invention shows four rows of tubes, all of the disclosure in this invention apply to bundles constructed with one or more rows. Similarly, each row may have a different finned tube diameter such as, the first row could be one and one-half inch in diameter, the second row one and one-forth inch in diameter and the third row one inch in diameter.

The present disclosure includes that contained in the appended claims as well as that of the foregoing description. Although this invention has been described in its preferred forms with a certain degree of particularity, it is understood that the present disclosure of the preferred form has been made only by way of example and numerous changes in the details of construction and combination and arrangement of parts may be resorted to without departing from the spirit and scope of the invention.

Now that the invention has been described,

What is claimed is:

1. A steam powered system comprising a turbine for converting steam energy into mechanical energy upon expansion of steam therein, a boiler for generating steam to be fed to the turbine, and a conduit arrangement coupling the boiler to the turbine and then recoupling the turbine exhaust to the boiler through steam condensing mechanisms, the condensing mechanisms including:

a plurality of finned tubes through which the expanded exhaust steam flows and is condensed;

a plurality of bundle front headers at the lower ends of the condensing tubes for receiving exhaust steam from the turbine;

a plurality of bundle divided rear headers, one for each tube row in the bundle, at the higher ends of the condensing tubes for receiving non-condensible gasses; and means in the rear and last headers to remove non-condensible gasses from the rear headers along their full length.

2. The system as set forth in claim 1 wherein the last mentioned means includes a suction sparger extending the length of each rear header with a plurality of orifices spaced along the length of the sparger.

3. The system as set forth in claim 1 wherein the draining condensate inside the tubes flows downwardly against the upward flow of the steam in a scrubbing manner for reheating purposes.

4. The system as set forth in claim 3 and further including condensate reheating means in the front headers positioned in the path of the falling condensate to bring the condensate back to saturation temperature.

5. For use in a steam condenser, a condensing and draining mechanism comprising:

a plurality of condensing tubes in a bundle through which steam may flow for being condensed into water and continually drained therefrom;

a plurality of front headers at the lower ends of the condensing tubes for receiving steam to be condensed;

a plurality of rear headers at the upper ends of the condensing tubes for receiving non-condensible gases from the condensing tubes; and a selected air-flow zone of relatively small proportions located above the bundle with reduced hot-air exhaust temperatures achieved by lowering steam condensing rates in that air-flow zone of the bundle for the purpose of providing the desired air temperature reduction for the proper functioning of re-condenser tubes located in the selected air-flow zone.

6. A mechanism to remove non-condensible gasses in a steam condenser comprising:

a plurality of condensing tubes through which exhaust steam may flow for being condensed into water and non-condensible gasses to be removed;

a plurality of lower headers at the input end of the condensing tubes for receiving exhaust steam to be condensed;

a plurality of rear headers at the output ends of the condensing tubes for receiving non-condensible gasses from the condensing tubes;

a suction sparger with orifices installed within each of the rear and last headers to receive non-condensible gas mixtures along the full length of the rear header;

a pre-condenser tube for each suction sparger; and connecting piping extending downwardly from each suction sparger toward the front headers to couple to each pre-condenser tube for the removal of the non-condensible gasses.

7. The mechanism as set forth in claim 6 wherein the plurality of condensing tubes are arranged in bundles with a plurality of rows of condensing tubes in each bundle and with each row of each bundle terminating in a separate rear header and with a separate suction sparger installed in each rear header.

8. The mechanism as set forth in claim 7 and further including an air-cooled pre-condenser tube set in a select and predetermined air temperature zone of the main condenser coupling a preselected suction sparger from each tube row of each bundle.

9. The mechanism as set forth in claim 8 and further including a fist-stage steam jet air ejector for each pre-condenser tube row.

10. The mechanism as set forth in claim 9 and further including a second-stage ejector, an intercondenser and an after-condenser coupled to the output of the first-stage steam jet air ejector.

11. The mechanism as set forth in claim 7 wherein the orifices in the suction sparger are of varying diameters for equalizing the mass flow of non-condensible gas mixtures (i) along the length of the rear headers and from the (ii) various bundles as located throughout the tower structure.

12. In a device for condensing steam and for removing the non-condensible gasses therefrom, an improved conduit arrangement defining a gas/vapor path inside a bundle extending from a lower header to an upper header with condensing tubes extending therebetween for steam as it moves from the lower header to the upper and last header of the bundle where the non-condensible gasses terminate and collect as residue, the arrangement also including a suction sparger pipe having a plurality of orifices located inside the upper header, the pipe having a length which spans the breadth of the upper header, the plurality of orifices located in the immediate vicinity of the tubes with its orifices positioned with respect thereto for the purpose of inducing the residue gasses leaving each steam condensing the tube to flow directly into the sparger for removal from the upper header and then subsequent discharge from the system.

* * * * *

UNITED STATES PATENT AND TRADEMARK OFFICE

CERTIFICATE OF CORRECTION

PATENT NO. : 4,905,474

DATED : March 6, 1990

INVENTOR(S) : Michael W. Larinoff

It is certified that error appears in the above-identified patent and that said Letters Patent is hereby corrected as shown below:

Line 61 of Column 3 before "steam" change "fist-stage" to -- first stage --

Line 20 of Column 11 after "the" change "to" to -- top --

Line 12 of Column 12 before "header" add -- last --

Line 20 of Column 13 (Line 18 of Claim 5) after "of" change "re-condenser" to -- pre-condenser --

Line 22 of Column 14 (Line 4 of Claim 11) after "mixtures" add -- in each comparable row --

Signed and Sealed this

Thirtieth Day of June, 1992

*Attest:*

DOUGLAS B. COMER

*Attesting Officer*

*Acting Commissioner of Patents and Trademarks*